US005155298A

United States Patent [19]

Koontz

[11] Patent Number: 5,155,298

[45] Date of Patent: Oct. 13, 1992

[54] THERMALLY ACTIVATED CASE VENTING SAFETY APPARATUS

[75] Inventor: Robert A. Koontz, Ridgecrest, Calif.

[73] Assignee: The United States of America as represented by the Secretary of the Navy, Washington, D.C.

[21] Appl. No.: 769,933

[22] Filed: Sep. 30, 1991

[51] Int. Cl.[5] ..... F42B 39/20

[52] U.S. Cl. ..... 102/481

[58] Field of Search ..... 102/481, 293

[56] References Cited

U.S. PATENT DOCUMENTS

| | | | |
|---|---|---|---|
| 3,665,857 | 5/1972 | Radnich et al. | 102/481 |
| 3,927,791 | 12/1975 | Hershberger | 220/89 |
| 3,972,289 | 8/1976 | Morris | 102/70 |
| 3,992,997 | 11/1976 | McCubbin et al. | 102/56 |
| 4,004,516 | 1/1977 | Johnson et al. | 102/24 |
| 4,022,130 | 5/1977 | Johnson et al. | 102/56 |
| 4,041,869 | 8/1977 | San Miguel | 102/56 |
| 4,084,512 | 4/1978 | San Miguel | 102/103 |
| 4,114,369 | 9/1978 | Crowley | 60/200 |
| 4,411,199 | 10/1983 | Yates et al. | 102/481 |
| 4,423,683 | 1/1984 | Telmo | 102/481 |

*Primary Examiner*—Charles T. Jordan

*Attorney, Agent, or Firm*—Harvey A. Gilbert; Melvin J. Sliwka; John L. Forrest, Jr.

[57] ABSTRACT

A thermally activated case venting safety apparatus is used to minimize the potential for detonation of a warhead or other encased explosive when such item is subjected to excessive thermal environments. An aft end closure plate to a warhead casing is secured using an expandable snap ring with a temperature activated releasing mechanism. The snap ring is expanded using a caliper device with an adjustable slide assembly which adjust the snap ring to the required dimensions. An eutectic solder plug or similar plug is attached to the bottom base of the adjustable slide assembly and holds the snap ring in the expanded position. The plug will melt at a predetermined temperature and thus allow the expandable snap ring to retract. Once the snap ring has retracted, the closure plate will be ejected due to the internal case pressure and the warhead case will vent.

23 Claims, 3 Drawing Sheets

FIG. 2
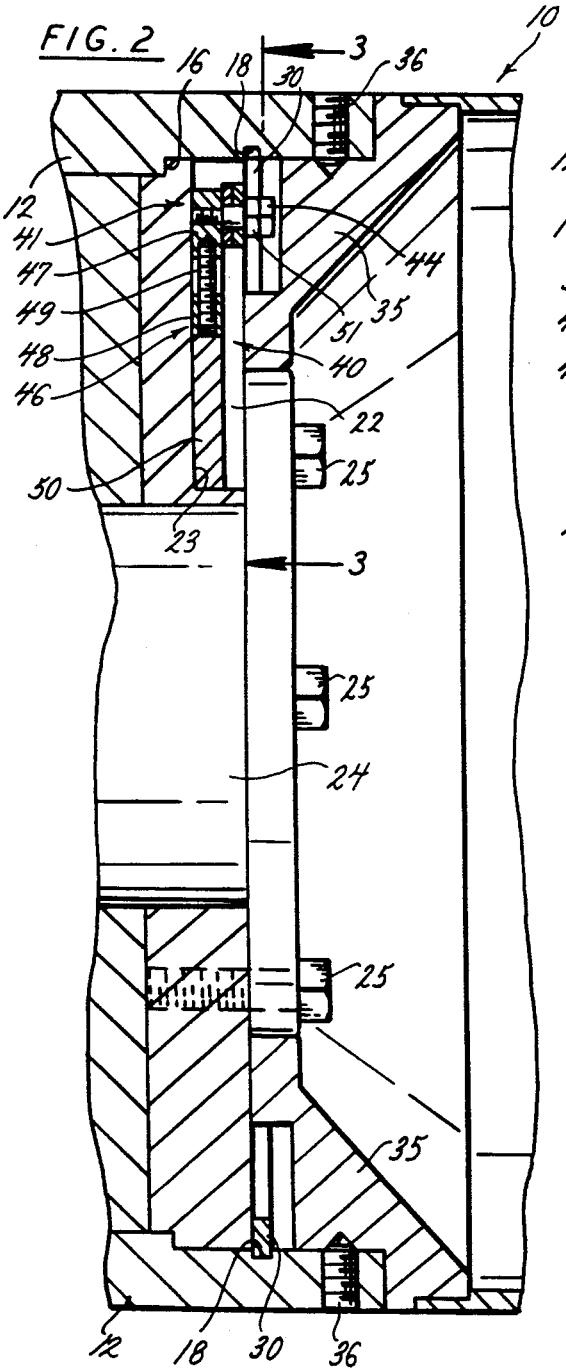
FIG. 5.
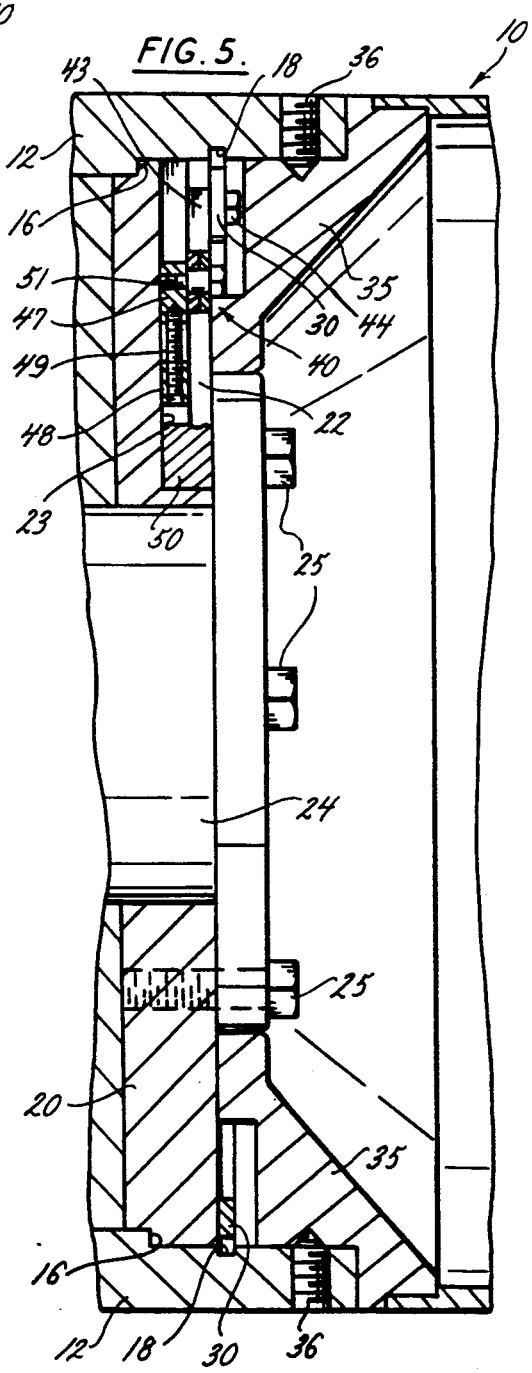
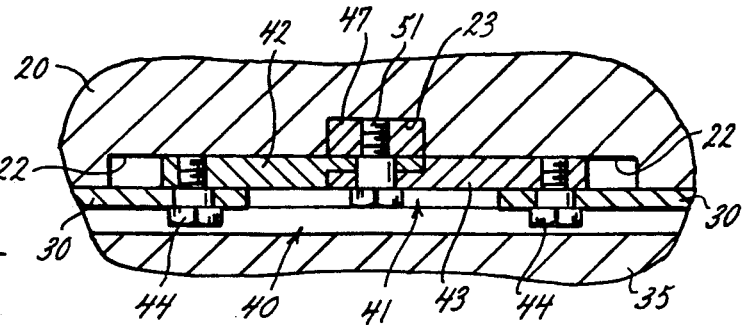
FIG. 6.

FIG. 3.
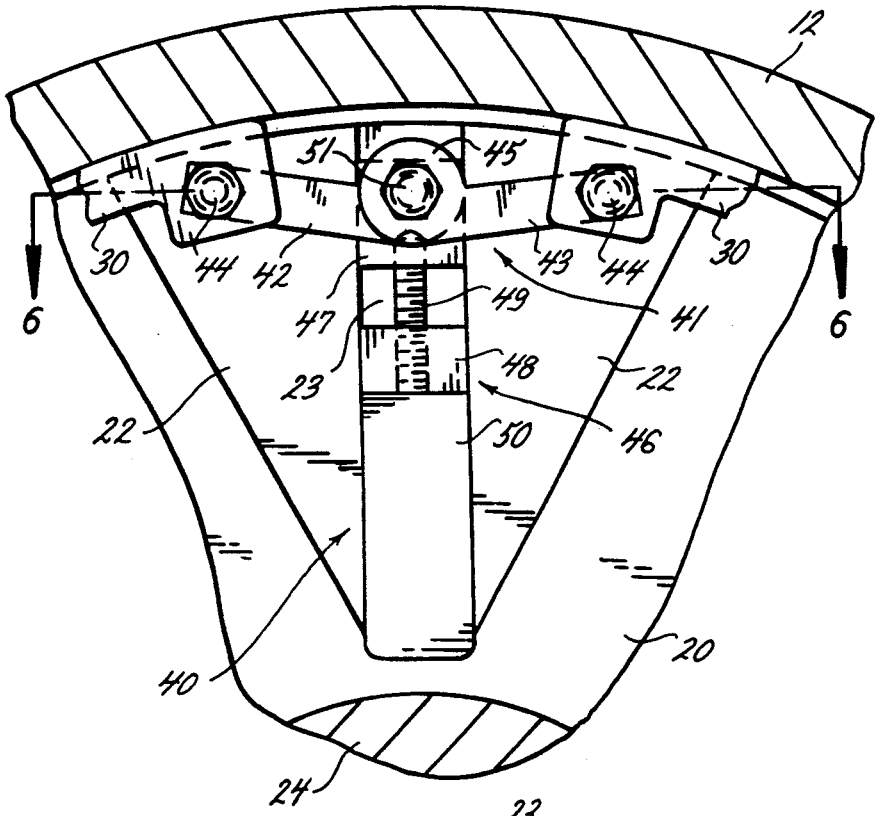
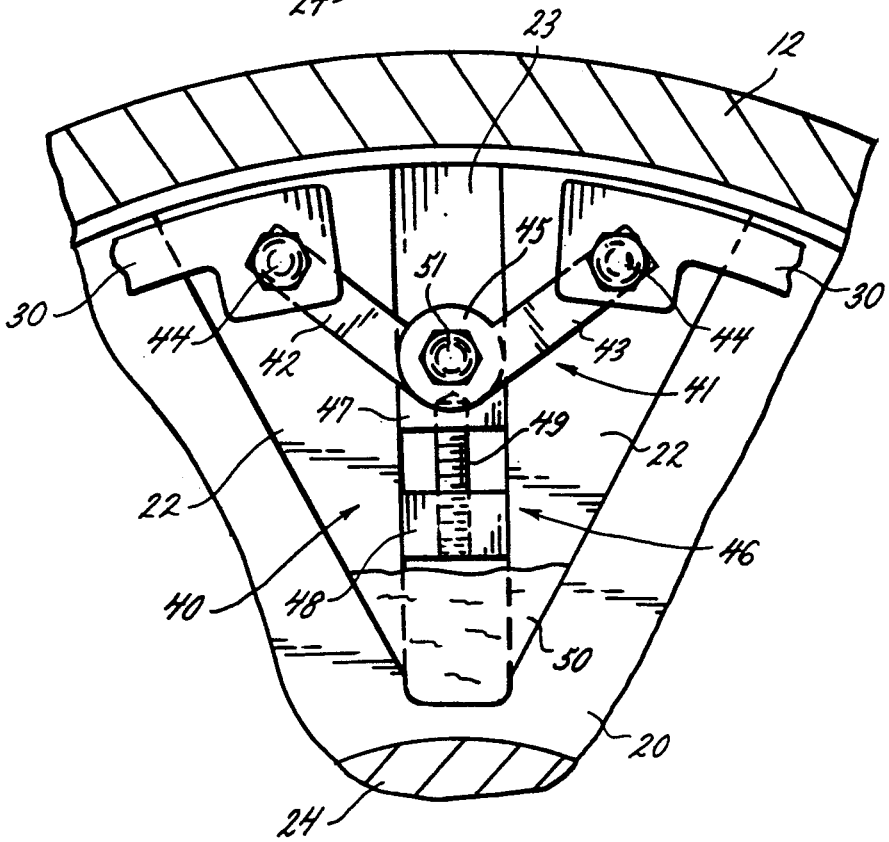
FIG. 4.

THERMALLY ACTIVATED CASE VENTING SAFETY APPARATUS

BACKGROUND OF THE INVENTION

The present invention relates to explosive warheads and specifically to the means for making such warheads safer when exposed to thermal heating. This increased safety aspect is achieved without compromising the warhead's structural integrity.

When dealing with explosive ordnance it is important that precautions have been taken to assure that the ordnance is incapable of being accidentally exploded in high temperature environments.

Warhead cook-off is the response of the explosive warhead to excessive thermal environments such as a fire or abnormally high ambient temperatures. Cook-off is an undesirable reaction of the explosive which typically starts as a burning or deflagration process but can transition to a detonation process if the explosive remains confined. The detonation of a warhead under such circumstances can cause severe property damage and loss of life. Restricting cook-off reactions to merely burning of the warhead material will substantially improve the safety aspects of the warhead.

To avoid the deflagration to detonation transfer, in a warhead cook-off reaction, one can employ a method releasing the explosive material from the confines of the warhead case or housing. This method is known as venting the warhead. By providing a large vent area the severity of cook-off reaction can be mitigated.

Prior art technology utilized longitudinal stress riser grooves in the warhead case. These grooves would allow the case to rupture when exposed to a high thermal environment. This rupture of the warhead case would release the confinement of the explosive and provide a large vent area. The longitudinal stress riser grooves, however, weaken the structural integrity of the warhead case which degrades the overall warhead performance in specific operational environments.

SUMMARY OF THE INVENTION

The present invention provides a simple and low cost means to minimize the reaction, known as cook-off, of a warhead or other encased explosive. The present invention provides for warhead venting in high temperature environments through the aft end of the casing. As a result, this invention solves the problem of warhead cook-off without compromising the structural integrity of the casing, and enhances the survivability of the casing in these high temperature environments.

The present invention consists of a release mechanism for the aft end closure plate to the casing. This release mechanism is triggered by the melting of a eutectic solder plug at a predetermined temperature.

As a warhead or other encased explosive is exposed to this predetermined temperature, the release mechanism is activated. Subsequent to this thermal activation the internal pressure in the casing reaches a nominal level which will eject the aft end closure plate from the casing. Once the closure plate is ejected the explosive material can adequately vent, thus reducing the possibility of detonation.

It is an object of the invention to provide a safety apparatus for encased explosive material that will eliminate or minimize the likelihood of undesirable reactions caused by high temperature environments.

It is also an object of the invention to provide a safety apparatus that is activated at a predetermined temperature.

It is a further object of the invention to provide a safety apparatus which provides for warhead venting and which does not degrade the structural integrity of the casing.

The present invention satisfies the aforementioned objectives in a manner that is apparent from consideration of the drawings and the detailed description of the invention.

BRIEF DESCRIPTION OF THE DRAWINGS

FIG. 2 is a longitudinal partial cross section view of the casing, adapter plate, closure plate, snap ring and release mechanism.

FIG. 3 is a lateral partial aft end view taken along line 3—3 of FIG. 2 showing the snap ring, closure plate, casing, and release mechanism in the expanded position.

FIG. 4 is a lateral partial aft end view of the snap ring, closure plate, casing, and release mechanism in the fully retracted position.

FIG. 5 is a longitudinal partial cross section view of the release mechanism in the retracted position.

FIG. 6 is a partial cross section view of the release mechanism taken along line 6—6 of FIG. 3.

DETAILED DESCRIPTION

Figure 1:
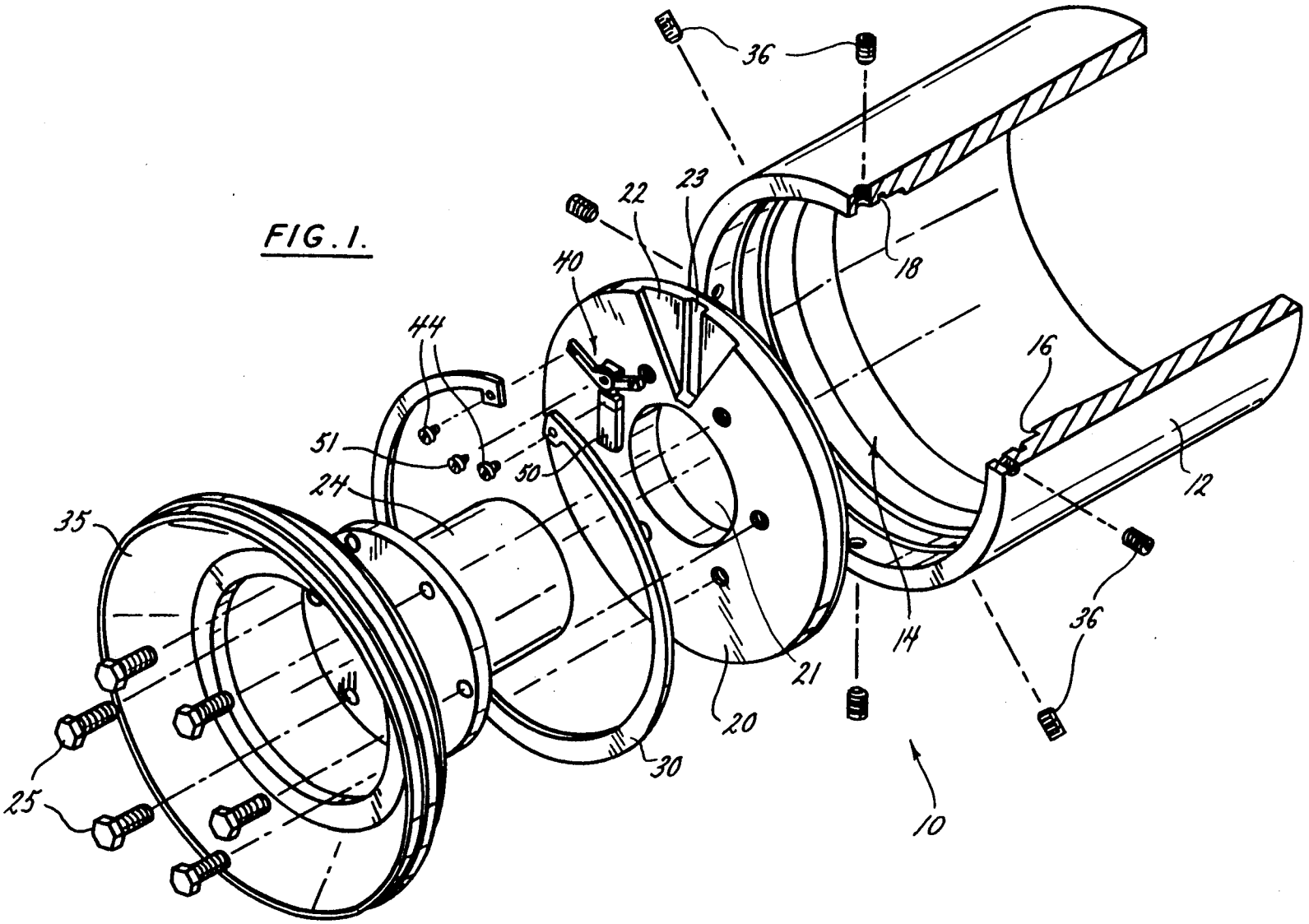
FIG. 1 is a exploded perspective of the present invention.

The present invention is a warhead venting safety apparatus (10) which will protect against warhead detonation in high thermal environments. This protection is afforded without compromising the structural integrity of the warhead case. The warhead venting safety apparatus consists of a warhead case, a closure plate, a means for securing the closure plate to the warhead case thereby enclosing the contents of the warhead case, and a means for releasing the closure plate which is triggered at a specified high temperature.

In the preferred embodiment as depicted in FIG. 1, the warhead case (12) is a cylindrical case which has an open-aft end (14). The warhead case (12) contains explosive material (not shown) and a cylindrical receptacle (not shown) in which an external fuze (24) is fitted. Referring now to FIG. 2, the interior surface of the case (12) has a casing shoulder (16) oriented toward the open aft end (14) of the case (12). The interior surface of the case also has an insert groove (18). This insert groove (18) is located aft of the casing shoulder (16).

A closure plate (20), shown clearly in FIG. 1, for the warhead case (12) is a metal disk which is dimensioned to fit inside the warhead case (12) and abut the casing shoulder (16). The closure plate (20) thus encloses the explosive material (not shown) inside the warhead case (12). At the center of the closure plate (20) is a hole (21), also seen in FIG. 1, which allows various inserts, such as the fuze (24) or other external booster charge, to be inserted into the warhead. Further, the closure plate (20) provides a mounting surface for the fuze (24) or other insert, which as shown in FIG. 1 is secured using six hexagonal head screws (25). Alternative methods of mounting the fuze (24) or other inserts to the closure plate (20) such as adhesives, set-screws, etc. can be employed.

The means employed by the present invention to secure the closure plate (20) to the warhead case (12) is an expandable member, which as shown is an expandable snap ring (30), which is dimensioned to fit in the insert groove (18). As shown in FIG. 2 and FIG. 5, the expandable snap ring (30) is a metal ring dimensioned such that when expanded, it will partially fit into the annular insert groove (18) on the interior surface of the warhead case (12) and will remain partially exposed in the aft-end of the case such that it overlaps and abuts the closure plate (20). Normal snap rings must be collapsed or retracted to fit into such annular grooves. In the present invention, however, the snap ring (30) must be expanded to fit into the insert groove (18). Once expanded, the snap ring (30) is held in place by a release mechanism (40). With this snap ring (30) and release mechanism (40) combination, the snap ring (30) can be manually expanded, manually retracted, as well as thermally activated or triggered to retract in high temperature environments.

The release mechanism (40) maintains the snap ring (30) in the expanded position and in the insert groove (18), the closure plate (20) and snap ring (30) combination will seal the explosive material (not shown) within the warhead case (12). This configuration of closure plate (20) and snap ring (30) also provides structural integrity to the warhead case (12) particularly during oblique penetration of hardened structures by the warhead in specific operational scenarios.

The means for releasing the closure plate (20) from the warhead case (12) in high temperature environments is also embodied in the release mechanism (40). FIG. 3 shows an aft end view of the snap ring (30), closure plate (20), and release mechanism (40) in the fully expanded position. The release mechanism (40) is the key feature to the present invention. In the fully expanded position, there is a natural tendency for the snap ring (30) to retract, radially inward, absent the release mechanism (40). The release mechanism (40) is comprised of an extension device such as a caliper device (41), an adjustable assembly such as an adjustable slide assembly (46), and an eutectic solder plug (50), all shown in the drawings. The plug (50) is the primary load carrying member of the release mechanism (40).

This plug (50) also governs the temperature at which the release mechanism (40) is thermally activated or triggered, thus permitting the expandable snap ring (30) to retract. This thermal activation occurs as the plug (50) reaches a predetermined threshold temperature and melts. When the plug (50) melts, the release mechanism (40) will no longer maintain the expandable snap ring (30) in the expanded position and the expandable snap ring (30) will retract. Once retracted, the snap ring (30) will no longer secure the closure plate (20) in place and permits the explosive to escape through the aft end of the warhead case (12).

The release mechanism (40) is disposed in two preformed grooves (22, 23) in the upper section of the closure plate (20). The pre-formed angular groove (22) accommodates the caliper device (41) in both the expanded and retracted positions as well as all intermediate positions. The vertical groove (23) is deeper than the angular groove (22) and will house the adjustable slide assembly (46) and the eutectic solder plug (50).

Referring now to FIG. 4, the release mechanism (40) of the present invention is shown in the retracted position. The caliper device (41) is comprised of a left arm (42) and a right arm (43) joined at the common pivot located at the caliper base (45). The caliper device (41) is pivotally attached to the snap ring (30). Specifically, in the preferred embodiment, the right arm (43) is pivotally attached to the snap ring (30) with a mounting screw (44). Similarly, the left arm (42) is also pivotally attached to the snap ring (30) with a mounting screw (44). The base (45) of the caliper device (41) is also attached to the adjustable slide assembly (46) with a mounting screw (51)

The caliper device (41) functions to expand and retract the snap ring (30) as the caliper device (41) is opened and closed respectfully. As the caliper device (41) is opened the pivotal rotation of both arms (42,43) about a common pivot located at the mounting screw (51) away from each other increase the angular displacement from a vertical axis passing through the base (45) of the caliper device (41). When the caliper device (41) is opening, the pivotal rotation for the left arm (42) occurs left of the vertical axis while the pivotal rotation for the right arm (43) occurs in the opposite direction or right of the vertical axis. This simultaneous pivotal rotation of arms (42) and (43) causes the snap ring (30) to expand, while generally maintaining its circular shape. Similarly, as the caliper device (41) is closed, both arms (42, 43) pivotally rotate toward each other causes the snap ring (30) to retract, while generally maintaining its circular shape.

Also shown in FIG. 3 and FIG. 4, the adjustable slide assembly (46) is the mechanism which opens or closes the caliper device (41) which in turn expands or allows the retraction of the snap ring (30). The adjustable slide assembly (46) has an upper base (47), a lower base (48), and a threaded shaft (49) connecting the upper base (47) to the lower base (48). The eutectic solder plug (50) is attached to the bottom of the lower base (48) as shown in FIG. 3. The upper base (47) of the adjustable slide assembly (46) is also attached to the base (45) of the caliper device (41). The adjustable slide assembly (46) operates to open or close the caliper device (41) by turning the lower base (48) and plug (50) along the threaded shaft (49) forcing the upper base (47) in an upward orientation. As the upper base (47) rises, the caliper device (41) opens forcing the snap ring to expand into the insert groove (18) holding the closure plate (20) securely in position in the warhead case (12). Similarly as the upper base (47) moves downward the caliper device (41) closes. In a high temperature environment, the solder plug (50) or similar removable plug will melt, or will be otherwise eliminated, allowing the snap ring (30) to retract. As the snap ring retracts, the upper base (47) and lower base (48) move in a downward direction as the caliper device (41) closes.

Referring back to FIG. 2 and FIG. 5, an adapter plate (35) is inserted into the aft end (14) of the warhead case (12) aft of the closure plate (20), snap ring (30), and releasing mechanism (40). The adapter plate (35) forces the closure plate (20) forward against the shoulder (16) on the interior surface of the warhead case (12). In the preferred embodiment, the adapter plate (35) is a conical shaped metal cup or other similarly shaped insert which fits snugly in the warhead case (12). Cone point radial set-screws (36) secure the adapter plate (35) to the warhead case (12). The purpose of the adapter plate (35) is to provide a small clearance (37) between the closure plate (20) and the snap ring (30) allowing the snap ring (30) to retract even if there exists internal case pressurization due to the increased internal temperatures.

In a high temperature environment, the internal temperature and pressure within the warhead case (12) will increase. When the internal temperature reaches a predetermined threshold value, the plug (50) will melt. As the plug (50) melts the release mechanism (40) activates as described above, and the snap ring (30) will retract, and withdraw from within the insert groove (18). Once the snap ring (30) is released the only confinement of the explosive material (not shown is that provided by the adapter plate (35) forcing the closure plate (20) forward. However, once the internal pressure of the warhead case (12) reaches a nominal level, the radial setscrews (36) will shear, freeing the adapter plate (35). The internal pressure of the warhead case (12) will cause the ejection of the closure plate (20) and adapter plate (35) thus allowing the warhead to vent.

The present invention has been described in detail in terms of the preferred embodiment. It should be understood by those skilled in the art that many variations of the invention may be practiced other than as specifically described.

What I now claim as the invention is as follows:

1. A case venting safety apparatus for a warhead that provides for case venting in high temperature environments which comprises:

a casing for said warhead having an aft end, said aft end defining an opening;

a closure plate dimensioned to fit snugly in said opening of said aft end of said casing; and a retractable thermally reactive means for removably securing said closure plate to said casing.

2. The case venting safety apparatus described in claim 1 wherein said casing comprises a cylindrical casing having an annular insert groove and a annular shoulder formed in said aft end of said cylindrical casing.

3. The case venting safety apparatus described in claim 2 wherein said closure plate comprises a cylindrical disk having a hole whereby a fuze can be inserted into said cylindrical casing through said hole and mounted to said closure plate.

4. The case venting safety apparatus described in claim 2 wherein said means for removably securing said closure plate to said cylindrical casing comprises:

a radially expandable snap ring dimensioned, when fully expanded, to fit snugly in said insert groove at said aft end of said casing, such that said closure plate is secured between said snap ring and said casing shoulder;

a thermally activated release mechanism connected to said snap ring such that said thermally activated release mechanism is activated when said apparatus reaches a predetermined temperature thereby causing said snap ring to retract; and a means for providing a small clearance between said closure plate and said expandable snap ring.

5. The case venting safety apparatus described in claim 4 wherein said means for providing a small clearance between said closure plate and said expandable snap ring comprises an adapter plate removably disposed in said aft end of said casing abuting said closure plate, and said adapter plate is further secured to said casing.

6. The case venting safety apparatus described in claim 5 wherein said adapter plate consists of a conical shaped cup dimensioned to fit in said aft end of said casing and abut said closure plate.

7. The case venting safety apparatus described in claim 4 wherein said thermally activated release mechanism further comprises:

a caliper device having a first arm and a second arm, each arm attached separately to said snap ring to allow for expansion and retraction of said snap ring, whereby said snap ring expands as said caliper device opens and said snap ring retracts as said caliper device closes;

an adjustable slide assembly for controlling expansion and retraction of said expandable snap ring, said adjustable slide assembly having a first base and a second base connected to said first base with a threaded cylindrical shaft having a longitudinal axis whereby said second base may be threadably moved along said longitudinal axis of said threaded cylindrical shaft and said first base is further connected to said caliper device, such that said caliper device opens and closes relative to the position of said adjustable slide assembly; and a removable plug disposed on said second base of said adjustable slide assembly such that when said plug is removed said adjustable slide assembly is positioned such that said caliper device closes and said snap ring retracts.

8. The case venting safety apparatus described in claim 7 wherein said caliper device further comprises:

a first arm having a base and an end opposite said base, said end of said first arm attached to said snap ring; and a second arm having a base and an end opposite said base, said end of said second arm attached to said snap ring and said second arm pivotally attached to said first arm at a common pivot located at said base of said second arm.

9. The case venting safety apparatus described in claim 7 wherein said removable plug is a eutectic solder plug having a melting point at a predetermined temperature.

10. A safety apparatus that will provide for case venting in high temperature environments which comprises:

a casing having an interior surface and an aft end defining an opening, and further having an insert groove and a shoulder on said interior surface proximate said aft end;

a closure plate dimensioned to fit snugly in said opening of said aft end of said casing and abut said casing shoulder;

an expandable member dimensioned, when fully expanded, to fit snugly in said insert groove at said aft end of said casing, such that said closure plate is secured between said expandable member and said casing shoulder;

a thermally activated release mechanism connected to said expandable member such that said thermally activated release mechanism is activated when said apparatus reaches a predetermined temperature thereby causing said expandable member to retract; and a means for providing a small clearance between said closure plate and said expandable member.

11. The case venting safety apparatus described in claim 10 wherein said expandable member is a radially expandable snap ring.

12. The case venting safety apparatus described in claim 10 wherein said thermally activated release mechanism further comprises:

an extension device attached to said expandable member to allow for expansion and retraction of said expandable member;

a means for adjusting said extension device for controlling expansion and retraction of said expandable member and connected to said extension device; and a removable plug disposed on said means for adjusting such that when said apparatus reaches a predetermined temperature, said removable plug will melt, thereby causing said expandable member to retract.

13. The case venting safety apparatus described in claim 12 wherein said extension device further comprises a caliper device having a first arm and a second arm, each arm separately attached to said expandable member to allow for expansion and retraction of said expandable member such that said expandable member expands as said caliper device opens and said expandable member retracts as said caliper device closes.

14. The case venting safety apparatus described in claim 13 wherein said means for adjusting comprises an adjustable slide assembly, said adjustable slide assembly having a first base and a second base connected to said first base with a threaded cylindrical shaft having a longitudinal axis, whereby said second base may be movably disposed along said threaded cylindrical shaft longitudinal axis and said first base is further connected to said extension device, such that said extension device opens and closes relative to the position of said adjustable slide assembly.

15. The case venting safety apparatus described in claim 12 wherein said removable plug comprises a eutectic solder plug having a melting point at a predetermined temperature, said eutectic solder plug disposed on said means for adjusting such that when said eutectic solder plug melts said expandable member retracts.

16. A method of fabricating a case venting safety apparatus to provide case venting in high temperature environments, comprising the steps of:

providing a cylindrical casing having an aft end and containing an explosive material, said cylindrical casing having an annular insert groove and a annular shoulder formed in said aft end;

inserting a closure plate dimensioned to fit snugly in said aft end of said casing and abut said annular shoulder;

inserting a radially expandable snap ring in said annular insert groove of said aft end of said casing;

connecting a thermally activated release mechanism to said expandable snap ring;

expanding said expandable snap ring to fit snugly in said annular insert groove at said aft end of said casing, such that said closure plate is secured between said snap ring and said annular shoulder of said casing;

adjusting said thermally activated release mechanism with an adjusting means whereby said expandable snap ring is secured in an expanded position and said thermally activated release mechanism is activated when said apparatus reaches a predetermined temperature thereby causing said expandable snap ring to retract; and placing an adapter plate removably disposed in said aft end of said casing and abutting said closure plate so that a small clearance is maintained between said closure plate and said snap ring.

17. The method of fabricating a case venting safety apparatus as described in claim 16 wherein the step of attaching a thermally activated release mechanism further comprises the steps of:

attaching an extension device to said expandable snap ring to allow for expansion and retraction of said expandable snap ring;

attaching an adjustable assembly to said extension device for controlling expansion and retraction of said expandable snap ring; and attaching a removable plug to said adjustable assembly such that when said apparatus reaches a predetermined temperature, said removable plug melts thereby causing said thermally activated release mechanism to activate and said expandable snap ring to retract.

18. A case venting safety apparatus for a warhead that provides for case venting in high temperature environments which comprises:

a cylindrical casing having an aft end, said aft end defining an opening, said cylindrical casing further having an annular insert groove and an annular shoulder formed in said aft end of said cylindrical casing;

a closure plate dimensioned to fit snugly in said opening of said aft end of said casing;

an expandable snap ring dimensioned, when fully expanded, to fit snugly in said insert groove at said aft end of said casing, such that said closure plate is secured between said expandable snap ring and said casing shoulder;

a thermally activated release mechanism connected to said expandable snap ring such that said thermally activated release mechanism is activated when said apparatus reaches a predetermined temperature thereby causing said expandable snap ring to retract; and a means for providing a small clearance between said closure plate and said expandable snap ring.

19. The case venting safety apparatus described in claim 18 wherein said means for providing a small clearance between said closure plate and said expandable snap ring comprises an adapter plate removably disposed in said aft end of said casing abutting said closure plate, and said adapter plate is further secured to said casing.

20. The case venting safety apparatus described in claim 19 wherein said adapter plate consists of a conical shaped cup dimensioned to fit in said aft end of said casing and abut said closure plate.

21. The case venting safety apparatus described in claim 19 wherein said thermally activated release mechanism further comprises:

a caliper device having a first arm and a second arm, each arm attached separately to said snap ring to allow for expansion and retraction of said snap ring, whereby said snap ring expands as said caliper device opens and said snap ring retracts as said caliper device closes;

an adjustable slide assembly for controlling expansion and retraction of said expandable snap ring, said adjustable slide assembly having a first base and a second base connected to said first base with a threaded cylindrical shaft having a longitudinal axis whereby said second base may be threadably moved along said longitudinal axis of said threaded cylindrical shaft and said first base is further connected to said caliper device, such that said caliper device opens and closes relative to the position of said adjustable slide assembly; and a removable plug disposed on said second base of said adjustable slide assembly such that when said plug is removed said adjustable slide assembly is positioned such that said caliper device closes and said snap ring retracts.

22. The case venting safety apparatus described in claim 21 wherein said caliper device further comprises:

a first arm having a base and an end opposite said base, said end of said first arm attached to said snap ring; and a second arm having a base and an end opposite said base, said end of said second arm attached to said snap ring and said second arm pivotally attached to said first arm at a common pivot located at said base of said second arm.

23. The case venting safety apparatus described in claim 21 wherein said removably plug is a eutectic solder plug having a melting point at a predetermined temperature.

* * * * *